US007267227B2

(12) United States Patent
Dubois et al.

(10) Patent No.: US 7,267,227 B2
(45) Date of Patent: Sep. 11, 2007

(54) NEST STACKABLE AND INTERLOCKING CONTAINER

(75) Inventors: Jean-Marc Dubois, Bremgarten (CH); Boris Schwab, Vogelsang bei Turgi (CH)

(73) Assignee: George UTZ Holding AG, Bremgarten (CH)

( * ) Notice: Subject to any disclaimer, the term of this patent is extended or adjusted under 35 U.S.C. 154(b) by 633 days.

(21) Appl. No.: 10/484,097

(22) PCT Filed: Jul. 12, 2002

(86) PCT No.: PCT/CH02/00385

§ 371 (c)(1),
(2), (4) Date: Jan. 14, 2004

(87) PCT Pub. No.: WO03/008202

PCT Pub. Date: Jan. 30, 2003

(65) Prior Publication Data

US 2004/0206656 A1 Oct. 21, 2004

(30) Foreign Application Priority Data

Jul. 14, 2001 (CH) ..... 1307/01

(51) Int. Cl.
*B65D 21/032* (2006.01)

(52) U.S. Cl. ..... 206/506

(58) Field of Classification Search ..... None
See application file for complete search history.

(56) References Cited

U.S. PATENT DOCUMENTS

| | | | | |
|---|---|---|---|---|
| 2,029,746 | A * | 2/1936 | Tufts et al. | 206/506 |
| 4,573,577 | A * | 3/1986 | Miller | 206/506 |
| 4,804,092 | A * | 2/1989 | Jones | 206/519 |
| 5,609,254 | A * | 3/1997 | Loftus et al. | 206/506 |

FOREIGN PATENT DOCUMENTS

EP 0 697 341 A1 2/1996

* cited by examiner

*Primary Examiner*—Stephen J. Castellano
(74) *Attorney, Agent, or Firm*—Janet Sleath; Speckman Law Group PLLC

(57) ABSTRACT

The present invention relates to a nest stackable and interlocking container. The nest stackable and interlocking container comprises a base plate, four side walls, and an upper peripheral edge integrally formed on the side walls, wherein at least one bow is pivotably held in the edges. The bow protrudes into the open interior of the container in an extended position and is received in the edges in a retracted position. The bow comprises two elbow-shaped end areas, which are respectively guided in a semi-circular groove arranged in the side walls of the container. Latching positions are provided in the groove so that the bow may be latched in various positions.

5 Claims, 4 Drawing Sheets

NEST STACKABLE AND INTERLOCKING CONTAINER

FIELD OF THE INVENTION

The invention relates generally to a nest stackable and interlocking container.

BACKGROUND OF THE INVENTION

Nest stackable containers are containers which may be mutually interlocked in the empty state in order to enable easy transport of the empty containers. The containers are rectangular in cross section and the side walls are provided with a slightly conical arrangement towards the floor, so that a second similar container can be placed in a rectangular opening provided on the first container. To ensure that such nest stackable containers can also be stacked in the filled state, at least one pivotably held supporting strut which limits the rectangular opening of the container may be provided, so that the bottom of a similar container can stand on the supporting struts.

EP-A-O 697 341 describes a nest stackable container wherein U-like supporting struts, which can be brought into three different positions are provided on the opposing shorter side walls. Each supporting strut has a pivot bearing the edge region at a distance from the face wall and can thus be pivoted between a position projecting into the opening of the container and a position releasing the opening. Moreover, the supporting strut can be swiveled via the released position (when resting on the side wall) downwardly to a stop, so that a second similar container can be stacked into the first container. The ends of the supporting struts are loosely guided in an opening guide means whereby the ends may fall out from the container when the same container is turned around. In order to bring the supporting struts into the lower position, the ends need to be pushed inwardly so that they can be brought out via a connecting link. The latching of the supporting strut in the two upper positions is also not ensured.

It is the object of the present invention to provide a nest stackable and interlocking container in which the supporting struts or bows are guided in an improved manner, so that they cannot fall out of the container and the bow can be latched in any position.

SUMMARY OF THE INVENTION

The nest stackable and interlocking container comprises a base plate, four side walls, and an upper peripheral edge integrally formed on the side walls, wherein at least one bow is pivotably held in the edge. The bow protrudes into a free opening of the container when in an extended position and is received in the edge when in a retracted position. The bow comprises two elbow-shaped end areas, which are respectively guided in a semi-circular groove positioned in the side walls of the container. Latching positions are provided in the groove so that the bow may be latched in various different positions. The bow is guided in the semi-circular groove from a first position, in which a second container may be stacked, into a second position, in which the second container may be stacked at a middle height, and into a third position in which the second container may be interlocked completely. The peripheral edge may be provided with a longitudinal groove in which the bow is received in the third position. The bow end areas are preferably provided with an outwardly bent configuration and held in T-shaped openings provided on the edge. The container may be provided with at least two oblong openings on opposite side walls which may be used as handles. The container may also be provided with a label holder. The label holder is preferably positioned at a point approximately half way up the side wall, whereby the oblong openings of the second container interlocked in the third position are at approximately the same height as the label holder. The nest stackable and interlocking container of the present invention has the advantage that the pivotable bow is always held in a guide means and may be latched in the various positions with ease.

BRIEF DESCRIPTIONS OF THE DRAWINGS

Further advantages and embodiments of the present invention are explained in the following description with reference to the attached drawings, wherein.

The same reference numerals have been used in the figures for the same elements and first-time explanations relate to all figures, unless stated expressly otherwise.

DETAILED DESCRIPTION OF THE INVENTION

Figure 1:
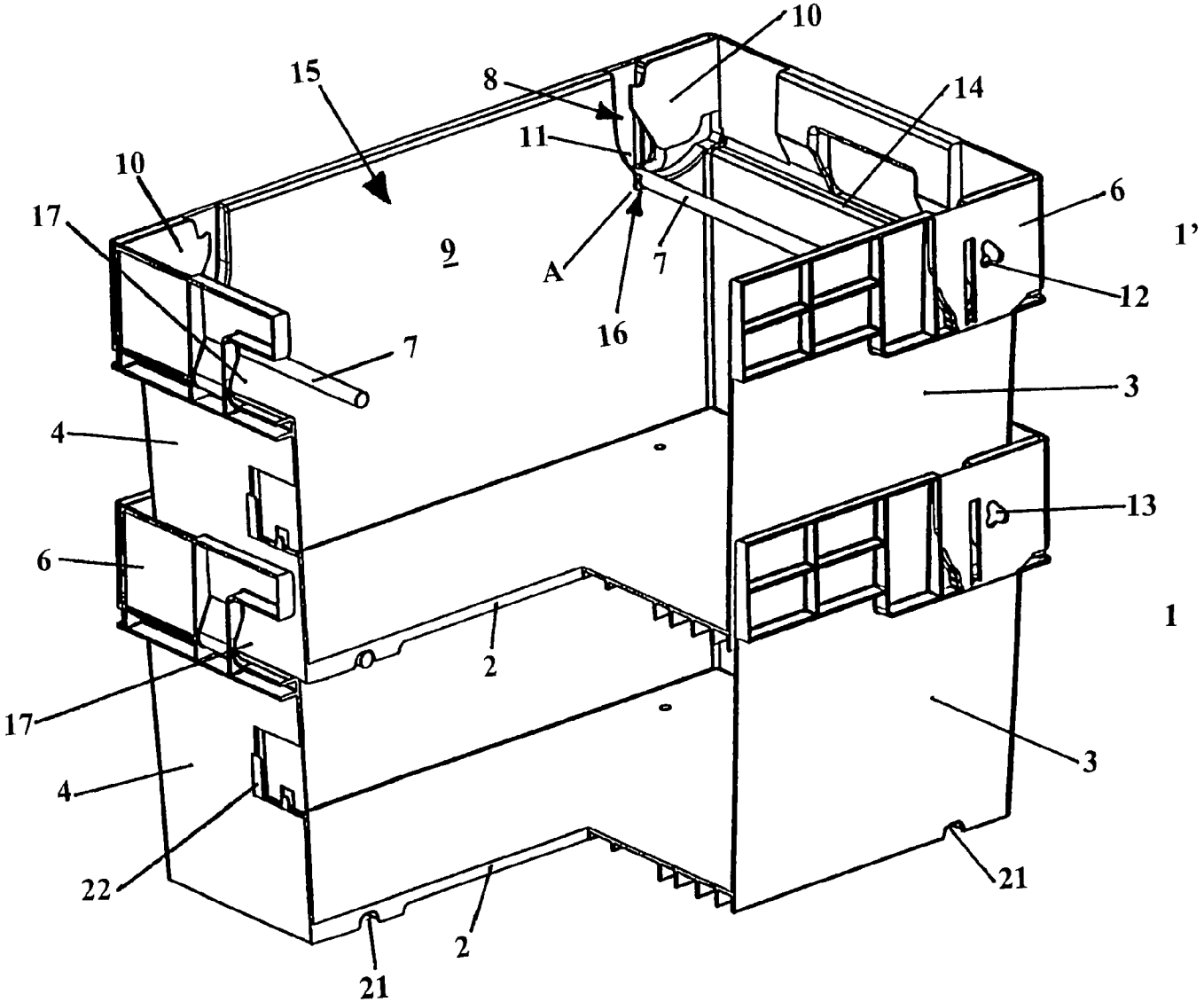
FIG. 1 shows a perspective and partially sectional view of two nest stackable and interlocking containers of the present invention stacked on top of each other with two bows in a lower position.
Figure 2:
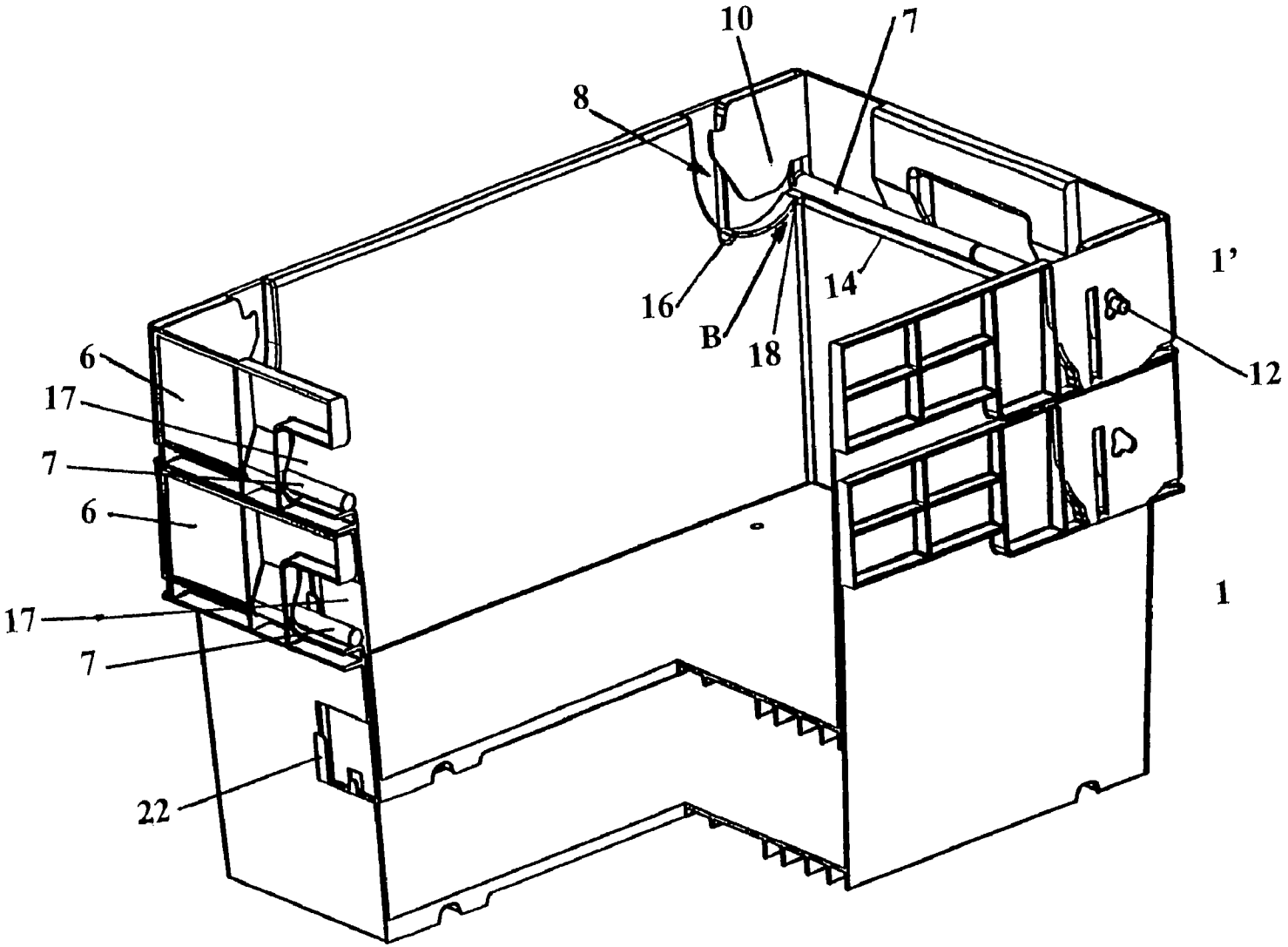
FIG. 2 shows a perspective and partially sectional view of the two nest stackable and interlocking containers of FIG. 1 with the bows in a position for releasing the opening.

FIG. 1 shows two identical cuboid nest stackable and interlocking containers 1, 1'. Each container comprises a base plate 2, two longer side walls 3, and two shorter side walls 4. The side walls 3 and 4 are provided with a slightly conical arrangement towards the base plate 2. In an outwardly projecting edge 6, two bows 7 are pivotablly held in a semi-circular groove 8 in the interior surface 9 of side walls 3. The groove 8 is bordered by a projecting semi-circular tab 10 which is positioned at a right angle to the shorter side wall 4. The bows 7 comprise a knee element 11 and an outwardly bent end 12 which is held in a T-shaped opening 13 in the edge 6. A longitudinal groove 14 is provided on the inside of each shorter side wall 4 below edge 6, in which the bows 7 may be received, as shown in FIG. 2. The rectangular base plate 2 comprises shorter sides than the external dimensions of the upper free opening, or interior, 15 of container 1 so that a second identical container 1' may be placed in container 1. In position A as shown in FIG. 1, a small round cavity 16 is provided in the groove 8, so that the bows 7 may be latched thereon and project into the free opening 15 of the container 1 whereby container 1' may be interlocked in a middle position in the lower container 1. In position A the container may be approximately half filled with goods or merchandise. Furthermore, reinforced oblong preferably rectangular openings 17, are provided as handles in edge 6 on the shorter side walls 4, so that the container 1 can be grasped and lifted with ease.

Figure 3:
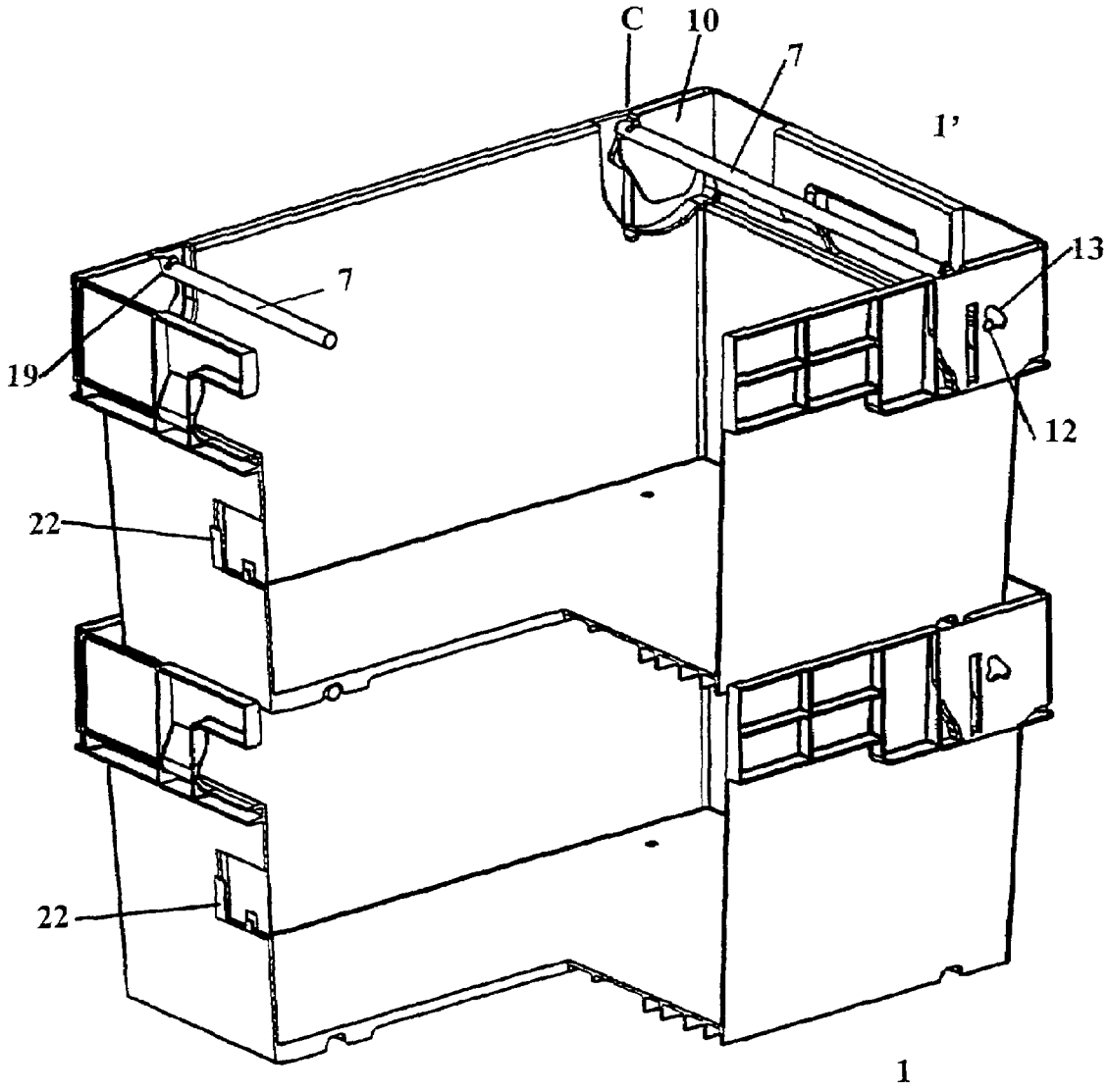
FIG. 3 shows a perspective and partially sectional view of the two nest stackable and interlocking containers of FIG. 1 with the bows in an upper position.
Figure 4:
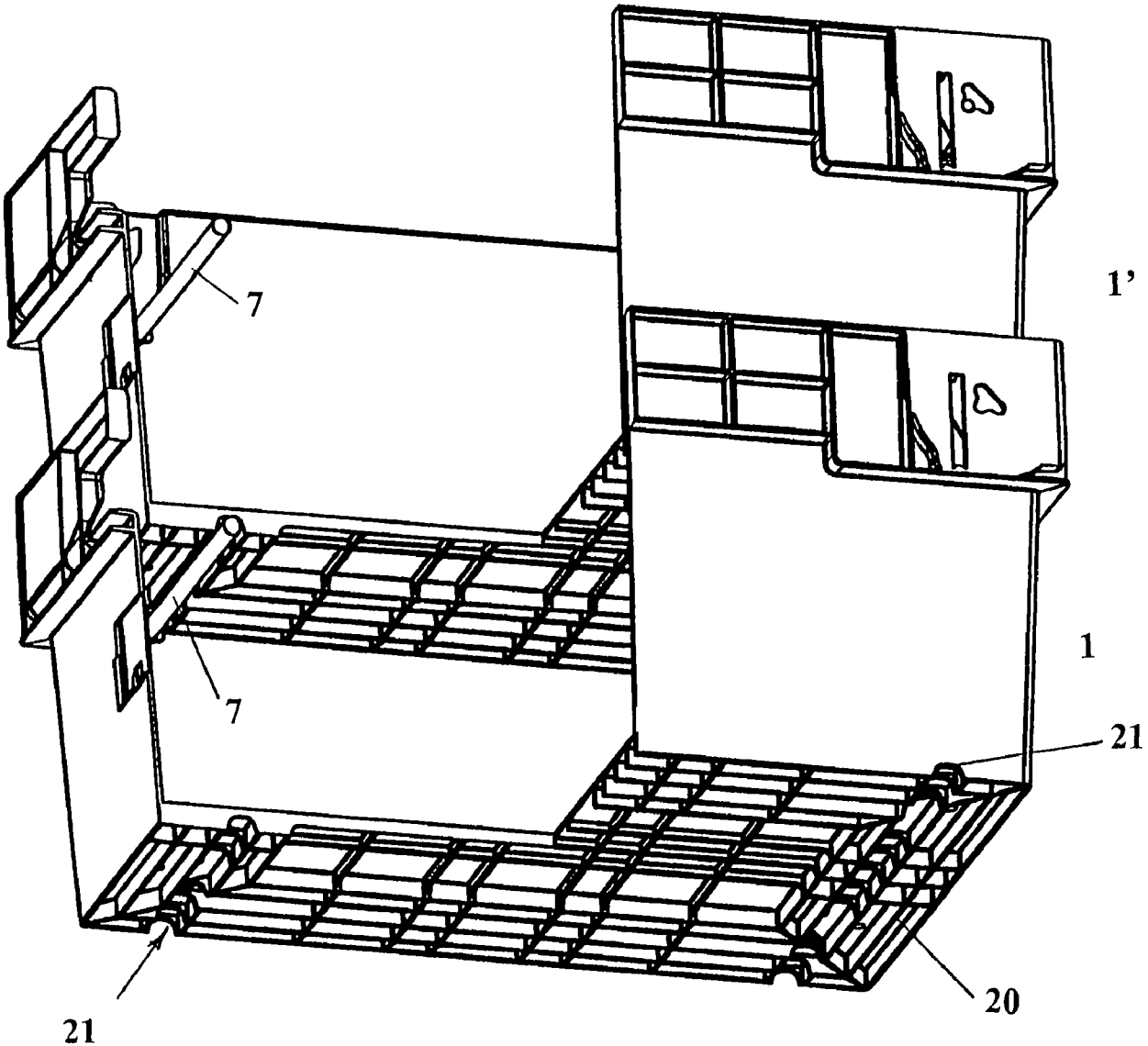
FIG. 4 shows a bottom and partially sectional view of the two nest stackable and interlocking containers of FIG. 1 with the bows in the lower position.

FIG. 2 shows the nest stackable and interlocking containers 1 and 1' of FIG. 1 with the two bows 7 in position B for releasing the opening. Each bow 7 is latched on both sides in a further small round recess 18 at the end of the groove 8 and lies approximately flush relative to the lower edge of the opening 17, so that the openings 17 are covered only slightly by the bow 7. The bow 7 can be pressed through the openings 17 from the position B to position A as shown in FIG. 1. With the two bows 7 in position B, the container 1' can be interlocked completely in container 1, with edge 6 of the container 1' lying on edge 6 of container 1. The bows 7 lie in the longitudinal grooves 14, so that they are flush with the inner wall of the container 1. FIG. 3 shows the two nest stackable and interlocking containers 1 and 1' with the two bows 7 in the higher position C, with the knee elements 11 being latched in a connecting link 19 of the tab 10. FIG. 4 shows a bottom view of the two nest stackable and interlocking containers in position A as in FIG. 1. The ribbed lower side 20 of base plate 2 is shown with the longitudinal grooves 21 on both sides which are used for receiving the bow 7.

The bow 7 is thus pivotably guided in a semi-circle formed by groove 8 from position A for stacking in a middle height, as shown in FIG. 1, to position B for nest stacking, as shown in FIG. 2, and to position C for normal stacking, as shown in FIG. 3. The small recesses 16 and 18 and the connecting link 19 are used together with the T-shaped opening 13 on edge 6 for the purpose of latching the bow 7 on the knee element 11. The required play in order to bring the bow 7 from the respective latching position is released by the T-shaped opening 13, i.e. by lifting the bow 7, the bent end 12 is pushed to another corner of the T-shaped opening 13, and as a result, the bow 7 comes to lie in the groove 8. When the bow 7 is not completely latched in position B, the bow 7 is pressed during nest stacking by a similar container 1' automatically into latching position B. In all positions A, B and C, the rectangular openings or handles 17 are for the most part left free by bow 7.

As is shown in FIGS. 1-3, a label holder 22 is provided approximately halfway up the shorter side walls 4. As shown in FIG. 2, when the containers are in the interlocked position, the label holder 22 lies at the same height as the rectangular opening 17 of the lower container 1 and is thus still readable. In positions C (FIG. 3) and A (FIG. 1), the label holder 22 of the upper container 1' is not covered by the lower container 1.

In another embodiment, not shown in the figures, container 1 is provided within a single bow 7 on one side with the opposite side of the container 1 being provided with a steeper side wall 4 and a projecting inner edge.

We claim:

1. A nest stackable and interlocking container, comprising:

(a) abase plate;

(b) four vertical side walls connected to the base plate to form an open interior;

(c) an upper peripheral edge integrally formed on the side walls;

(d) at least two semi-circular grooves, each groove being provided on an opposing side wall; and (e) at least one bow pivotably held in the peripheral edge and protruding into the interior of the container in an extended position and being received in the peripheral edge in a retracted position, wherein the at least one bow comprises two elbow-shaped end areas, each end area being guided in one of the at least two semi-circular grooves, and wherein latching positions are provided in each of the at least two semi-circular grooves whereby the at least one bow may be latched in various positions, wherein the container further comprises at least two oblong openings on the opposite side walls which may be used as handles and a label holder positioned approximately half way up one of the side walls, whereby, when a second container is completely interlocked in the container, the label holder is at approximately the same height as one of the at least two oblong openings.

2. The container according to claim 1, wherein the bow is guided in the semi-circular groove from a first position, wherein a second container may be stacked in the container at a first height, to a second position wherein the second container may be stacked at a second, middle, height, to a third position wherein the second container may be interlocked completely.

3. The container according to claim 2, wherein the edge comprises at least one longitudinal groove in which the at least one bow is received in the third position.

4. The container according to claim 1, wherein the container comprises two bows provided on opposite sides of the container.

5. The container according to claim 1, wherein at least one of the latching positions is provided as a recess.

* * * * *